US011065495B1

(12) United States Patent
Savarino

(10) Patent No.: US 11,065,495 B1
(45) Date of Patent: Jul. 20, 2021

(54) SPRING ANCHOR BAR AND CARRIAGE STOP ASSEMBLY

(71) Applicant: BALANCED BODY, INC., Sacramento, CA (US)

(72) Inventor: Christopher J. Savarino, Sacramento, CA (US)

(73) Assignee: BALANCED BODY, INC., Sacramento, CA (US)

( * ) Notice: Subject to any disclaimer, the term of this patent is extended or adjusted under 35 U.S.C. 154(b) by 0 days.

(21) Appl. No.: 15/469,127

(22) Filed: Mar. 24, 2017

Related U.S. Application Data

(60) Provisional application No. 62/331,360, filed on May 3, 2016.

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 22/00*** | (2006.01) |

(52) U.S. Cl.
CPC ..... *A63B 21/0428* (2013.01); *A63B 21/023* (2013.01); *A63B 21/4045* (2015.10); *A63B 22/0076* (2013.01); *A63B 22/0089* (2013.01)

(58) Field of Classification Search
CPC ..... A63B 21/0428; A63B 21/4045; A63B 21/02–21/0557; A63B 22/0087; A63B 22/0076
See application file for complete search history.

(56) References Cited

U.S. PATENT DOCUMENTS

| | | | | |
|---|---|---|---|---|
| 1,621,477 | A | 8/1925 | Pilates | |
| 6,120,425 | A | 9/2000 | Endelman | |
| 7,163,500 | B2 | 1/2007 | Endelman et al. | |
| 7,288,053 | B2 | 10/2007 | Endelman et al. | |
| 7,857,736 | B2 * | 12/2010 | Merrithew | A63B 21/00 482/121 |
| 7,931,570 | B2 * | 4/2011 | Hoffman | A63B 21/055 482/123 |
| 8,152,705 | B2 * | 4/2012 | Rooks | A63B 21/022 482/122 |
| 8,394,005 | B2 * | 3/2013 | Solow | A63B 21/023 482/121 |
| 10,046,193 | B1 * | 8/2018 | Aronson | A63B 21/025 |
| 2005/0085357 | A1 * | 4/2005 | Endelman | A63B 21/055 482/142 |

(Continued)

*Primary Examiner* — Nyca T Nguyen
(74) *Attorney, Agent, or Firm* — Greenberg Traurig, LLP

(57) ABSTRACT

A coil spring anchor bar and carriage stop is disclosed for use in a reformer exercise apparatus to fasten ends of one or more coil springs extending from the movable carriage to the foot end of the reformer frame. The anchor bar and carriage stop includes an elongated metal plate having a longitudinally flat straight portion extending between first and second ends, a first longitudinally straight curved portion curved in a first direction and extending between and forming part of the first and second ends, and a second curved portion between the first and second ends curved in a direction opposite the first direction. A pair of spaced apart carriage stops extend orthogonally from the straight portion engage the movable carriage to maintain a predetermined minimum distance between the anchor bar and the carriage when the anchor bar is supported from the foot end of the reformer frame.

18 Claims, 5 Drawing Sheets

(56) References Cited

U.S. PATENT DOCUMENTS

2005/0113227 A1* 5/2005 Endelman ..... A63B 21/04
482/142
2008/0248935 A1* 10/2008 Solow ..... A63B 21/023
482/142

* cited by examiner

SPRING ANCHOR BAR AND CARRIAGE STOP ASSEMBLY

CROSS REFERENCE TO RELATED APPLICATIONS

This application claims the benefit of priority of U.S. Provisional Patent Application Ser. No. 62/331,360, filed May 3, 2016 entitled Spring Anchor Bar And Carriage Stop Assembly, the content of which is hereby incorporated by reference in its entirety.

BACKGROUND OF THE DISCLOSURE

The present disclosure is directed to exercise equipment and more particularly to an anchor bar and carriage stop assembly for use in a reformer exercise apparatus.

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus were developed by Joseph Pilates, and more recently, have been evolved by his students and others. One current apparatus is commonly referred to as a "reformer" which includes a wheeled platform carriage which rides on parallel rails or tracks on or forming part of a rectangular wooden or metal frame. The carriage is connected to a series of parallel springs or elastic members which are in turn connected to a foot end of the rectangular frame. My U.S. Pat. Nos. 6,120,425, 7,163,500 and 7,288,053 reflect some of the evolutionary developments that have taken place since 1927.

These patents disclose anchor bar and carriage stop assemblies that maintain a constant minimum distance between the carriage and the spring anchor bar while a user adjusts the distance between the anchor bar and the foot end of the reformer frame. Each of these assemblies involves the use of a number of separate component parts each of which adds to the cost of manufacture. Therefore there is a need for a simplified structure that can be utilized in a reformer exercise apparatus to maintain a predetermined minimum distance between the carriage and the anchor bar while changing the anchor bar position from the end of the reformer frame.

SUMMARY OF THE DISCLOSURE

An embodiment of an apparatus in accordance with the present disclosure may be utilized in a reformer exercise apparatus that includes a frame having a head end, a foot end and two spaced parallel side members, a movable carriage mounted to the side members for movement between the head end and foot end of the frame, and one or more resilient biasing members each having one end fastened between the carriage and the foot end of the frame. An anchor bar and carriage stop assembly is fastened to the side members adjacent the foot end. This assembly includes a pair of anchor bar support brackets each fastened to one of the side members adjacent the foot end of the frame. Each bracket has a plurality of spaced apart upright curved slots therein that open and curve downward from a top side of the bracket to a closed end adjacent the bottom edge of the bracket. An elongated anchor bar plate member having opposite ends, commonly referred to as a "springbar" is adapted to be carried in a matching pair of the slots in the support brackets in order to secure one or more of the resilient biasing members to the foot end of the frame.

The anchor bar plate member is an elongated sheet metal body that has opposing ends and has a flat planar portion in a longitudinal direction spanning between the ends. The planar portion merges with a first curved straight portion spanning between the opposing ends. This first curved portion is shaped complementary to the upright curved slots in the support brackets. The plate member carries one or more carriage stops projecting outward from the planar portion for engaging the carriage to maintain a predetermined minimum distance between the carriage and the anchor bar plate member when the plate member is positioned in or moved between different matching pairs of the slots in the support brackets.

The anchor plate member preferably has a central cutout forming a plurality of spaced apart upwardly protruding anchor tabs each for receiving and holding a free end of one of the resilient biasing members. The anchor plate member also has a second curved straight portion merging with the first curved portion. This second curved straight portion curves in an opposite direction from the first curved portion and provides rigidity to the structure of the anchor plate member.

An exemplary embodiment of an apparatus in accordance with the present disclosure may also be viewed as an apparatus for fastening one or more resilient biasing members extending from a movable carriage to an anchor bar located at one of a plurality of different anchor positions spaced from a foot end of a reformer frame while maintaining a common predetermined minimum distance between the carriage mounted on the reformer frame and the anchor position. One embodiment incudes a pair of anchor bar support brackets each fastened to one of a pair of parallel side members of the frame adjacent the foot end of the frame. Each bracket has a plurality of linearly spaced apart upright curved open slots. Each slot corresponds to an anchor position spaced from the foot end of the frame.

An elongated anchor bar plate member having a longitudinal axis and opposite ends is adapted to be carried in a matching pair of the slots in the support brackets. This plate member has a planar portion extending straight along an axis spanning between the ends of the member and has a first curved portion parallel to the axis and also spanning between the ends. The first curved portion is shaped complementary to the upright curved open slots in the support brackets. A pair of carriage stops project outward from the straight portion of the anchor bar plate member for engaging the carriage to maintain a common predetermined minimum distance between the carriage and the anchor bar plate member when the plate member is positioned in any matching pair of slots in the support brackets.

An exemplary embodiment in accordance with the present disclosure may alternatively be viewed as a coil spring anchor bar and carriage stop for use in a reformer exercise apparatus having a rectangular frame and a movable carriage mounted for reciprocal movement on the frame to fasten ends of one or more coil springs extending from the movable carriage to a location near a foot end of the reformer frame. This anchor bar and carriage stop incudes an elongated metal plate having a first longitudinally straight portion extending between first and second ends, a second longitudinally straight portion curved in a first direction and extending between and forming part of the first and second ends, and a third portion that is curved and which between the first and second ends is curved in a direction opposite the first direction. The plate has a cutout within the straight and first curved portions that defines a plurality of spaced spring anchor projections or tabs. Preferably the spring anchor projections each has a stem portion and a mushroom head portion extending upward from the stem portion into the cutout.

A pair of spaced apart carriage stops extend orthogonally outward from the straight portion for engaging the movable carriage to maintain a predetermined minimum distance between the anchor bar and the carriage when the anchor bar and carriage stop is supported from the foot end of the reformer frame in corresponding bracket slots.

Each carriage stop in an exemplary embodiment is a cylindrical body fastened to one of the first and second ends of the straight portion of the elongated metal plate. Each of the carriage stops preferably includes a cushion to absorb impact with the carriage. Further, the distal end of each carriage stop preferably includes a transverse notch to receive and engage a corresponding feature on the reformer carriage. Preferably this feature may be a part of the carriage frame.

The first curved portion of the plate is preferably curved on a radius forming an axis parallel to the longitudinally straight portion of the plate and which axis preferably passes through the notches formed in the distal ends of the carriage stops. The second curved portion is curved about a second axis spaced from and parallel to the longitudinally straight portion of the plate. The third curved portion is curved about a third axis parallel to and spaced from both the longitudinal straight portion and the second axis.

Further features, advantages and characteristics of the embodiments of this disclosure will be apparent from reading the following detailed description when taken in conjunction with the drawing figures.

DETAILED DESCRIPTION

Figure 1:
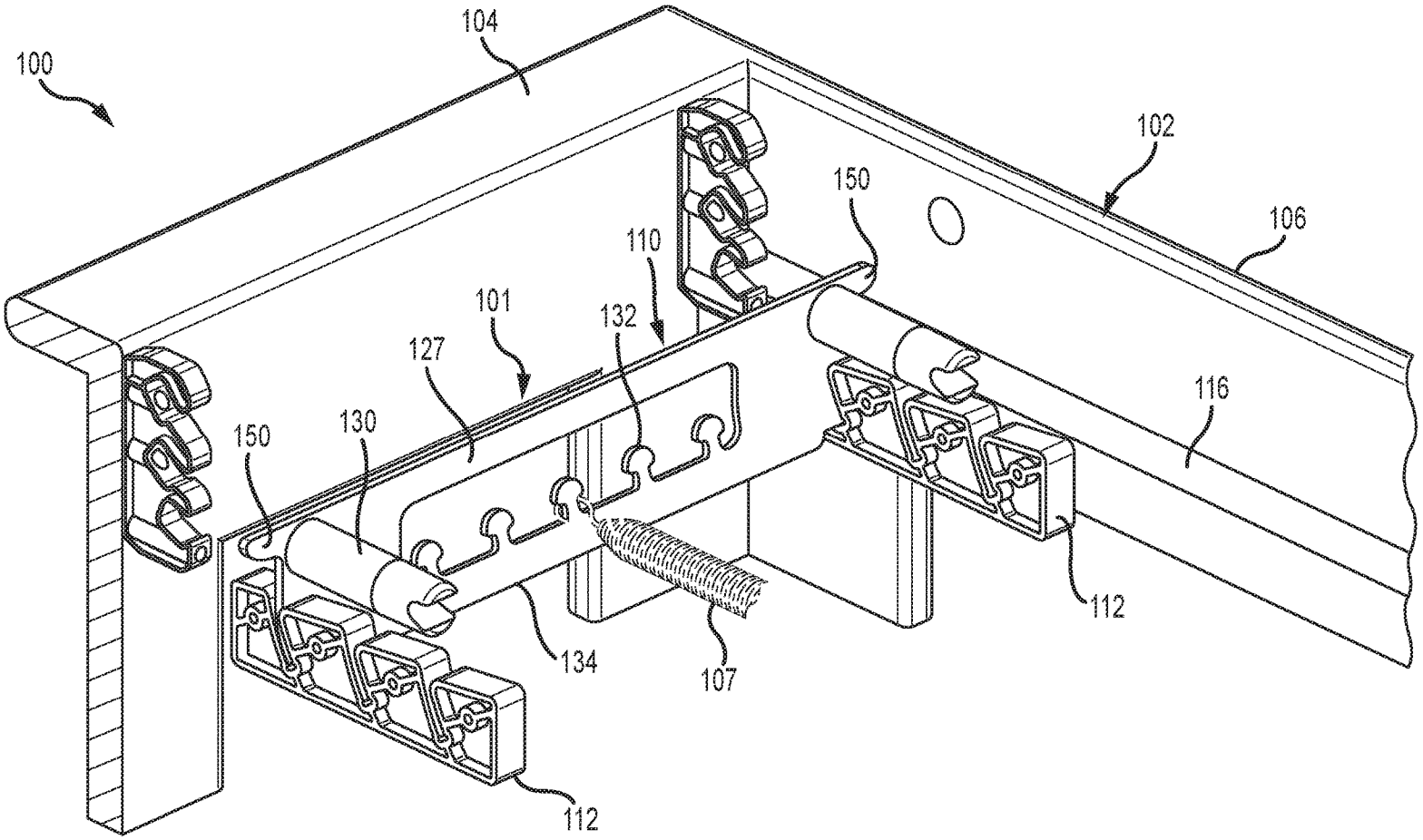
FIG. 1 is a partial perspective view of a foot end of a reformer exercise apparatus incorporating an embodiment in accordance with the present disclosure.
Figure 5A:
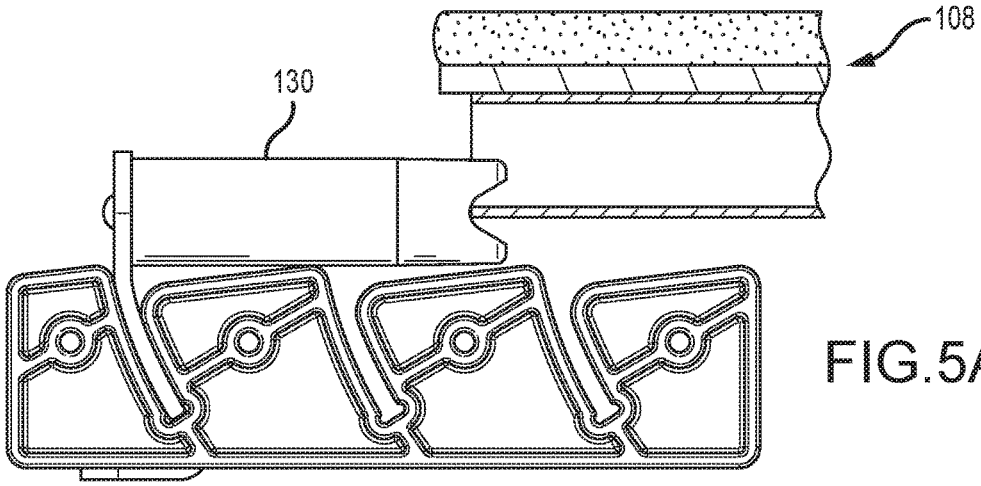
FIGS. 5A, 5B and 5C are sequential operational views of how the anchor bar and carriage stop in accordance with the present disclosure is removed from the support blocks in order to change the distance from the foot end of the reformer frame in accordance with the present disclosure.

An exemplary embodiment of a reformer exercise apparatus 100 incorporating an anchor bar and carriage stop assembly 110 in accordance with the present disclosure is shown in a perspective view of a foot end 104 of the reformer 100 in FIG. 1. The reformer apparatus 100 has a rectangular frame 102 that has a head end, a foot end 104 and two spaced parallel side members 106. A moveable carriage 108 is mounted so as to roll back and forth on tracks 109 fastened to the side rails 106. The carriage 108 is typically biased toward the foot end of the frame 102 by one or more springs 107. A user typically sits or lays on the carriage 108 and moves away from the foot end 104 of the frame 102 against spring tension. The carriage 108 is not shown in in FIG. 1 so that the arrangement of the anchor bar and carriage stop apparatus is clearly shown. The carriage 108 is shown in FIG. 5A.

Figure 2:
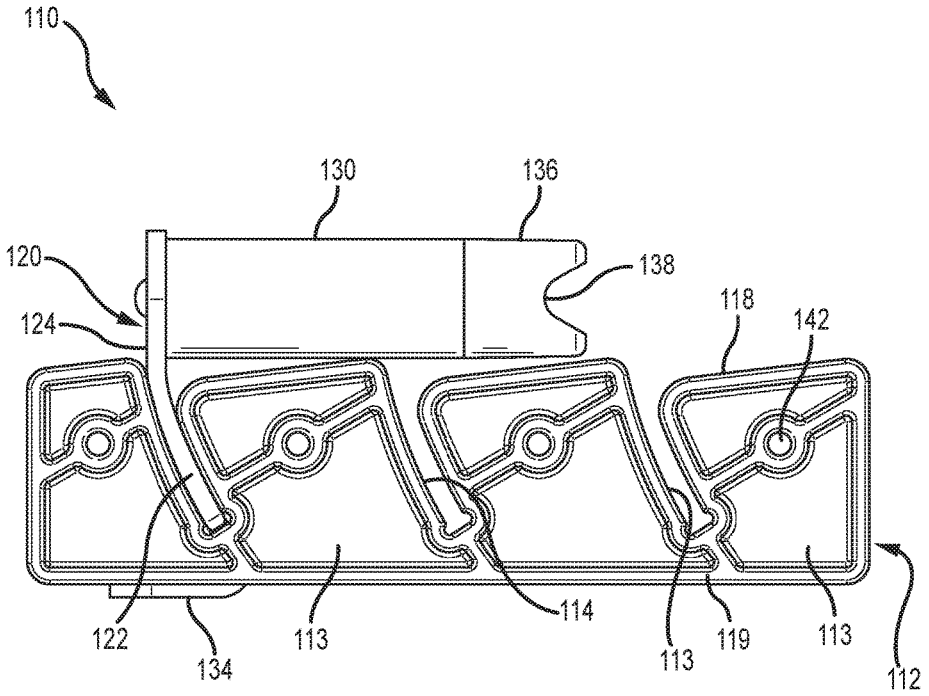
FIG. 2 is a left side view of the assembled anchor bar and carriage stop apparatus in FIG. 1.
Figure 3:
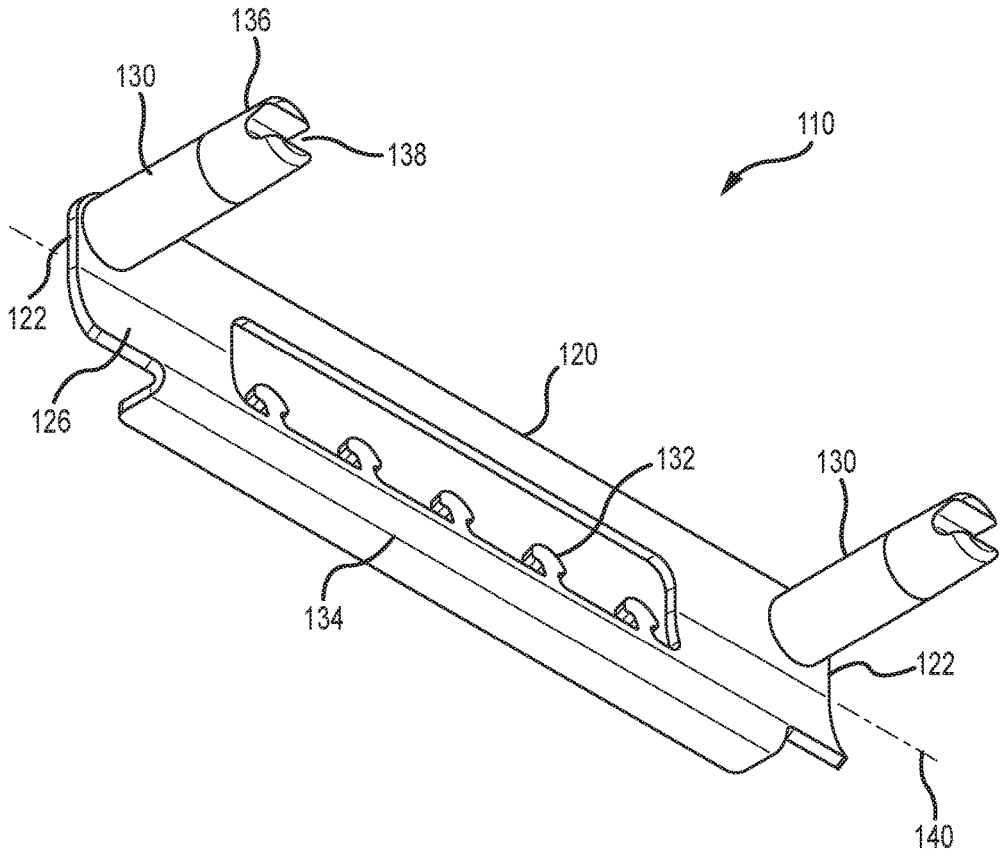
FIG. 3 is a separate perspective view of the exemplary anchor bar plate member shown in FIG. 1.
Figure 4:
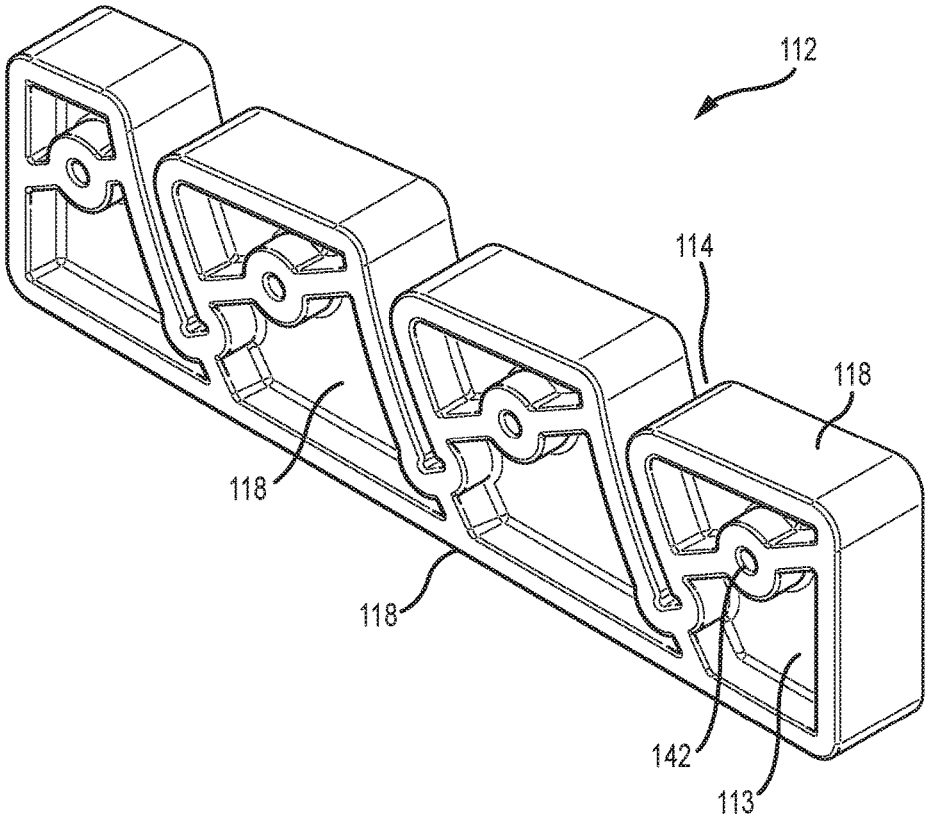
FIG. 4 is a separate perspective view of an anchor bar support block in accordance with the present disclosure.

The anchor bar and carriage stop assembly 110 is fastened to the side members 106 and includes a pair of anchor bar support brackets 112. A separate perspective view of an exemplary bracket 112 is shown in FIG. 3 and a partial side view of the apparatus 110 is separately shown in FIG. 2. Each bracket 112 is fastened preferably to a track 116 fastened in the side rails 106 of the frame 102 adjacent the foot end 104 of the frame 102 via a set of four fasteners (not shown) such as screws or bolts through four holes 142.

This support bracket 112 is preferably either an extruded aluminum or polymer elongated block shaped body separated into four contiguous segments 113 by three vertically open curved slots 114 that open through a top side 118 of the bracket 112. Each slot 114 has a closed bottom end adjacent a bottom side 119 of the bracket 112 such that the bracket 112 is a one-piece structure. Each of the segments 113 along the top side 118 is slightly slanted downward by several degrees toward the bottom side 119 rather than being parallel to the bottom side 119. This structure permits the upper side 118 to provide a resting guide point for the carriage stop 130 as is shown in FIG. 2. Each segment 113 has a central hole 142 for mounting of the bracket 112 as shown above. Preferably each of the segments 113 is thickened to provide reinforcement adjacent the slot 114 and adjacent the holes 142.

The anchor bar plate member 120 is an elongated generally straight sheet metal plate having a longitudinal axis and opposite ends 122 adapted to be carried in a pair of the slots 114 in the support brackets 112. This plate member 120 has a straight planar portion 124 that extends along the longitudinal axis of the plate member 120 spanning between and including ends 122. The plate member 120 also has a longitudinally straight first curved portion 126 that extends parallel to the axis 140 between the ends 122. The curved portion 126 at each end 122 is shaped complementary to and slips into the curved slot 114 in each of the support brackets 112. The planar portion 124 at each end 122 of the plate member 120 extends above the brackets 112 when the plate member 120 is fully inserted into one matched pair of slots 114 as is shown in FIGS. 1 and 2.

Extending orthogonally outward from each end 122 of the plate member 120 is a carriage stop 130. The carriage stop 130 preferably is fastened to the end 122 of the plate member 120 and includes a resilient stopper cushion 136 at its distal end for contacting a portion of the carriage 108. This cushion 136 may include a groove 138 for engaging a part of the carriage 108, such as a carriage frame member, such that the anchor bar plate member 120 can rotate about the engaging groove as will be further described below. The carriage stop 130 and the cushion 136 are preferably cylindrical in shape, and separately fastened, riveted, or otherwise bonded to the plate member 120. However, other shapes of carriage stop 130 are envisioned such as rectangular, a sheet metal L strip, or the stop 130 may be integrally formed from an elongated bent end portion of the plate member 120, bent so as to extend orthogonally to the straight portion 124.

The anchor bar plate member 120 preferably has an elongated central cutout 128 that forms a plurality of spaced apart anchor tabs 132, each for receiving and holding a free end of one of the resilient biasing members such as coil spring 107 shown in FIG. 1. The anchor bar plate member 120 further has a second curved portion 134 that extends longitudinally along the member 120 between the ends 122 and which curves in an opposite direction to that of the first curved portion 126. This second curved portion 134 between the ends 122 provides rigidity to the structure of the plate member 120.

The anchor bar and carriage stop 110 including plate member 120 with carriage stops 130 with cushions 136 is a single structure separately shown in FIG. 3. Each of the anchor tabs 132 preferably has a mushroom shape including a stem portion 144 and a dome shaped head portion 146. This mushroom shape effectively captures the hook or eye of the biasing member 107 as shown in FIG. 1. The cutout 128 that forms the anchor tabs 132 encompasses a portion of the straight flat portion 124 and a portion of the curved portion 126 of the plate member 120.

When the anchor bar and carriage stop 110, including plate member 120 with the two carriage stops 130 and cushions 136, is fastened to the carriage 108 via a biasing member (spring) 107, the carriage stop cushions 136 engage the carriage 108. The anchor bar plate member 120 and carriage stops 130 can be raised by a user lifting the stop 110 up and out of the bracket slots 114. When so raised, the anchor bar plate member 120 and carriage stops 130 will move together along with the carriage 108 as it rolls along the tracks 116 in the reformer frame 102. If the user then releases the anchor bar plate member 120 while the plate member 120 is riding along the top 118 of one of the segments 113, when a matching pair of slots 114 is encountered, the plate member 120 will simply drop into the slots 114 as is shown in FIG. 2.

Figure 5B:
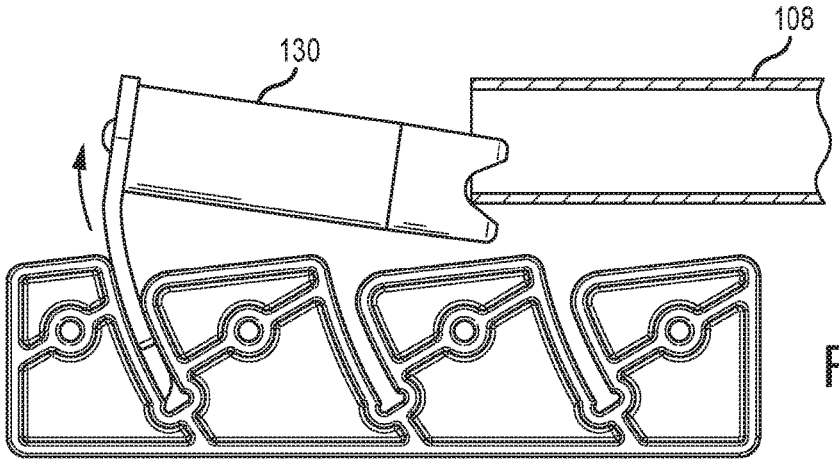
Figure 5C:
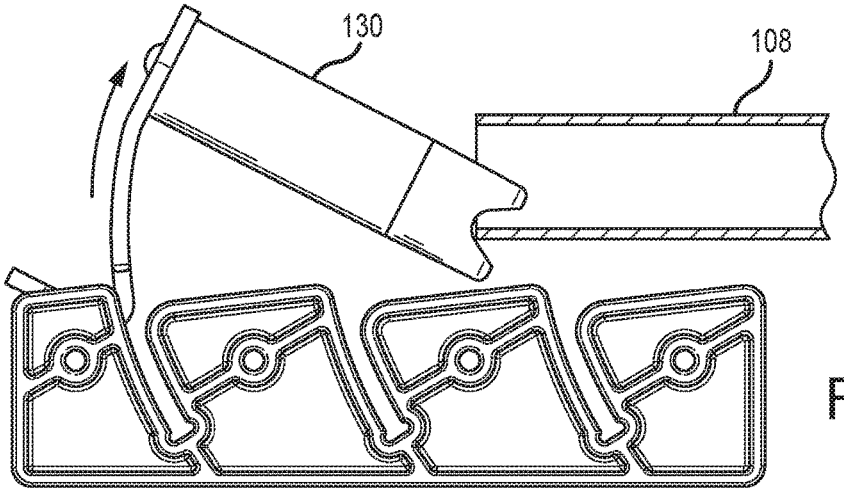

This movement is also shown in FIGS. 5A, 5B, and 5C. In FIG. 5A, the anchor bar and carriage stop 110 is shown with bar ends 122 in a locked position fully dropped into one of the slots 114. As can be seen, the notched end of the cushion 136 engages a feature of the carriage 108 such as an end of the carriage 108 frame. In FIG. 5B, a user is lifting the bar member 120 up out of the slots 114. Here the notched end of the cushion 136 still engages the feature on the carriage 108 because a spring 107 draws the carriage and anchor bar 120 toward each other. As can be seen in FIG. 5C, when the bar member 120 is fully lifted out of the slots 114, the cushion 136 still engages the feature on the carriage 108 and the anchor bar 120 with carriage stops 130 together with carriage 108 may be moved to a different set of slots 114. Hence a minimum distance equal to the distance between the cushion 136 and the bar 120 is always maintained.

Many changes may be made to the apparatus, which will become apparent to a reader of this disclosure. For example, instead of cylindrical carriage stops attached to the ends 122 of the straight portion 124 of the plate member 120, the ends 122 may be further elongated and bent at right angle to the longitudinal axis of the plate member 120 so as to project orthogonally to the plate 120 and form the carriage stop 130. An additional extension may be formed at the end of the end 122 to engage the corresponding feature on the carriage 108 rather than the grooved cushion 136 shown. All such changes, alternatives and equivalents in accordance with the features and benefits described herein, are within the scope of the present disclosure. Any or all of such changes and alternatives may be introduced without departing from the spirit and broad scope of my disclosure and invention as defined by the claims below and their equivalents.

What is claimed is:

1. A reformer exercise apparatus comprising:

a frame having a head end, a foot end and two spaced parallel side members;

a movable carriage mounted to the side members for movement between the head end and foot end of the frame;

one or more resilient biasing members each having one end fastened to the carriage; and an anchor bar and carriage stop assembly fastened to the side members comprising:

a pair of anchor bar support brackets each fastened to one of the side members adjacent the foot end of the frame, each bracket having a plurality of spaced apart upright curved slots therein;

an elongated anchor bar plate member having opposite ends adapted to be carried in a pair of the slots in the support brackets, the plate member having a central cutout forming a plurality of spaced apart anchor tabs each for receiving and holding a free end of one of the resilient biasing members, the plate member having a flat planar portion spanning between the ends merging with a first curved portion spanning between the ends, wherein the first curved portion is shaped complementary to the upright curved slots in the support brackets; and one or more carriage stops projecting outward from the planar portion for engaging the carriage to maintain a predetermined minimum distance between the carriage and the anchor bar plate member when the plate member is positioned in different pairs of the slots in the support brackets.

2. The reformer exercise apparatus of claim 1 wherein the anchor plate member further comprises a second curved portion that curves in an opposite direction to that of the first curved portion.

3. The reformer exercise apparatus of claim 2 wherein the second curved portion is bent at about a right angle to the plane of the planar portion.

4. The reformer exercise apparatus according to claim 1 further comprising the anchor plate member having a second curved portion merging with the first curved portion, the second curved portion curving in an opposite direction from the first curved portion.

5. The reformer exercise apparatus of claim 1 wherein the upright curved slots curve toward the carriage.

6. The apparatus according to claim 1 further comprising a second curved portion extending from the first curved portion in a direction opposite the first curved portion.

7. An apparatus for fastening one or more resilient biasing members extending from a movable carriage to an anchor bar located at one of a plurality of different anchor positions spaced from a foot end of a reformer frame while maintaining a common predetermined minimum distance between the carriage mounted on the reformer frame and the anchor position, the apparatus comprising:

a pair of anchor bar support brackets each fastened to one of a pair of parallel side members of the frame adjacent the foot end of the frame, each bracket having a plurality of spaced apart upright curved open slots therein, each slot corresponding to an anchor position from the foot end of the frame; and an anchor bar and carriage stop comprising:

an elongated anchor bar plate member having a longitudinal axis and opposite ends adapted to be carried in a pair of the slots in the support brackets, the plate member having a central cutout portion forming a plurality of spaced apart anchor tabs each for receiving and holding a free end of one of the resilient biasing members, the plate member having a planar portion along the axis spanning between the ends, and a first curved portion parallel to the axis and spanning between the ends, wherein the first curved portion is shaped complementary to the upright curved open slots in the support brackets; and a pair of carriage stops fastened to the planar portion and projecting outward from the planar portion for engaging the carriage to maintain a common predetermined minimum distance between the carriage and the anchor bar plate member when the plate member is positioned in any matching pair of slots in the support brackets.

8. The apparatus according to claim 7 further comprising a second curved portion merging with the first curved portion, wherein the second curved portion is curved in an opposite direction from the first curved portion.

9. An apparatus for fastening one or more resistance members extending from a movable carriage to a reformer frame comprising:

a first bracket fastenable to a first side rail of the reformer frame, the first bracket having a first plurality of spaced vertical curved open slots;

a second bracket fastenable to a second side rail of the reformer frame, the second bracket having a second plurality of spaced vertical curved slots each having an open upper end and a closed lower end;

an anchor plate member having a first end and a second end, wherein curved portions of the first and second ends are engageable within corresponding curved slots in the first and second brackets when said brackets are fastened to the reformer frame, wherein the anchor plate member is an elongated metal plate member having a flat straight portion extending in a longitudinal direction and a first curved portion merging with the straight portion extending straight in the longitudinal direction between the first and second ends, the plate member having a central cutout portion forming a plurality of spaced apart anchor tabs each for receiving and holding a free end of one of the resilient biasing members; and a carriage stop fastened to each of the first and second ends, wherein each stop extends away from the anchor plate member toward the movable carriage mounted for reciprocal movement on the frame between a head end and a foot end of the frame.

10. The apparatus according to claim 9 wherein the first and second brackets are fastened adjacent the foot end of the frame.

11. A coil spring anchor bar and carriage stop for use in a reformer exercise apparatus having a rectangular frame and a movable carriage mounted for reciprocal movement on the frame to fasten ends of one or more coil springs extending from the movable carriage to a location near a foot end of the reformer frame, the anchor bar and carriage stop comprising:

an elongated metal plate having a longitudinally flat straight portion extending between first and second ends, a first longitudinally straight curved portion curved in a first direction and extending between and forming part of the first and second ends, and a second curved portion between the first and second ends curved in a direction opposite the first direction, wherein the plate has a cutout within the flat straight portion and the first longitudinally straight curved portion defining a plurality of spaced spring anchor projections; and a pair of spaced apart carriage stops extending orthogonally from the flat straight portion for engaging the movable carriage to maintain a predetermined minimum distance between the anchor bar and the carriage when the anchor bar is supported from the foot end of the reformer frame.

12. The anchor bar and carriage stop according to claim 11 wherein each of the carriage stops includes a cushion to absorb impact with the carriage.

13. The anchor bar and carriage stop according to claim 11 wherein the second curved portion is curved about a second axis spaced from and parallel to the longitudinally straight portion of the plate.

14. The anchor bar and carriage stop according to claim 11 wherein the spring anchor projections each has a stem portion and a mushroom head portion extending from the stem portion into the cutout.

15. The anchor bar and carriage stop according to claim 11 wherein each carriage stop is a cylindrical body fastened to one of the first and second ends of the straight portion of the elongated metal plate.

16. The anchor bar and carriage stop according to claim 11 wherein the each carriage stop has a distal end including a notch for engaging a portion of the carriage.

17. A reformer exercise apparatus comprising:

a frame having a head end, a foot end and two spaced parallel side members;

a movable carriage mounted to the side members for movement between the head end and foot end of the frame;

one or more resilient biasing members each having one end fastened to the carriage; and an anchor bar and carriage stop assembly fastened to the side members, comprising:

a pair of anchor bar support brackets each fastened to one of the side members adjacent the foot end of the frame, each bracket having plurality of spaced apart upright curved slots therein;

an elongated anchor bar plate member having opposite ends adapted to be carried in a pair of the slots in the support brackets, the plate member having a flat planar portion spanning between the ends merging with a first curved portion spanning between the ends, wherein the first curved portion is shaped complementary to the upright curved slots in the support brackets; and one or more carriage stops projecting outward from the planar portion for engaging the carriage to maintain a predetermined minimum distance between the carriage and the anchor bar plate member when the plate member is positioned in different pairs of the slots in the support brackets, wherein each carriage stop is a cylindrical body fastened to the planar portion.

18. An apparatus for fastening one or more resilient biasing members extending from a movable carriage to an anchor bar located at one of a Plurality of different anchor positions spaced from a foot end of a reformer frame while maintaining a common predetermined minimum distance between the carriage mounted on the reformer frame and the anchor position, the apparatus comprising:

a pair of anchor bar support brackets each fastened to one of a pair of parallel side members of the frame adjacent the foot end of the frame, each bracket having a plurality of spaced apart upright curved open slots therein, each slot corresponding to an anchor position from the foot end of the frame; and an anchor bar and carriage stop comprising:

an elongated anchor bar plate member having a longitudinal axis and opposite ends adapted to be carried in a pair of the slots in the support brackets, the plate member having a planar portion along the axis spanning between the ends, and a first curved portion parallel to the axis and spanning between the ends, wherein the first curved portion is shaped complementary to the upright curved open slots in the support brackets; and a pair of carriage stops fastened to the straight portion and projecting outward from the straight portion for engaging the carriage to maintain a common predetermined minimum distance between the carriage and the anchor bar plate member when the plate member is positioned in any matching pair of slots in the support brackets wherein the carriage stops each include a cylindrical body fastened to the flat plate portion of the anchor bar plate member.

* * * * *